United States Patent [19]

Sears

[11] 3,940,010

[45] Feb. 24, 1976

[54] CAKE PLATE

[75] Inventor: Betty Sears, San Bruno, Calif.

[73] Assignee: Lawrence Peska Associates, Inc., New York, N.Y. ; a part interest

[22] Filed: Mar. 26, 1975

[21] Appl. No.: 562,255

[52] U.S. Cl. ..... 220/23.86; D7/83; D7/23

[51] Int. Cl.[2] ..... A47G 19/00

[58] Field of Search..... 220/1 R, 1 H, 23.83, 23.86; D7/23, 37, 76, 83; 206/501, 502

[56] References Cited

UNITED STATES PATENTS 2,619,816 12/1952 Lyon ..... 220/23.86

3,383,880 5/1968 Peters ..... D7/23

*Primary Examiner*—William Price

*Assistant Examiner*—Steven M. Pollard

*Attorney, Agent, or Firm*—Jack D. Slobod

[57] ABSTRACT

A cake plate has a food receiving top surface which is a centrally pointed conical well having an included angle ranging between 150 and 170 degrees. The top surface is configured to receive and support the domed surface of a cake.

8 Claims, 4 Drawing Figures

FIG. 1
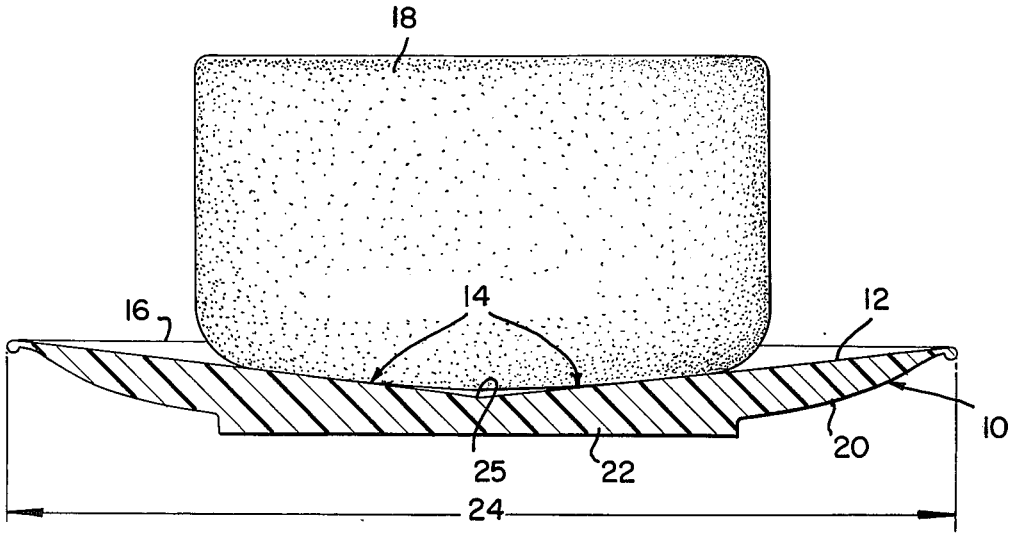
FIG. 2
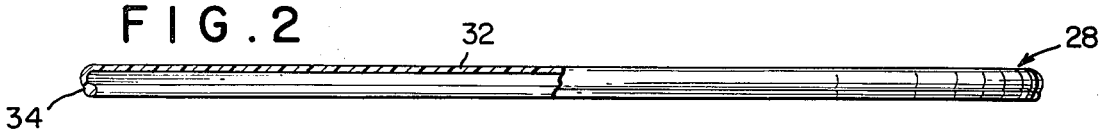
FIG. 3
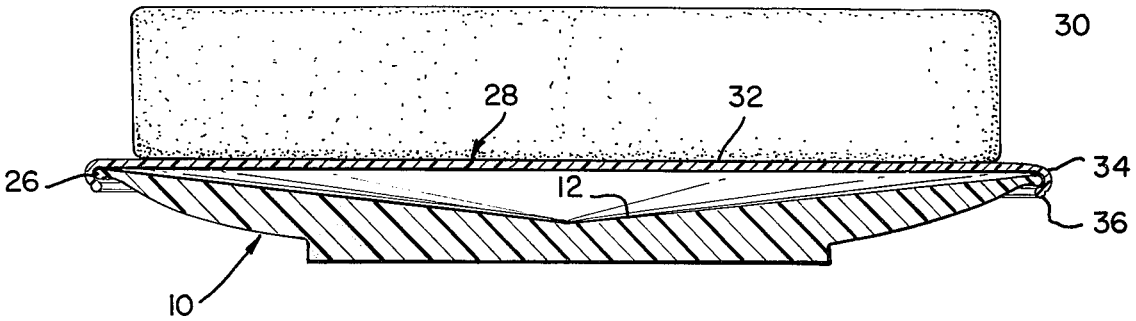
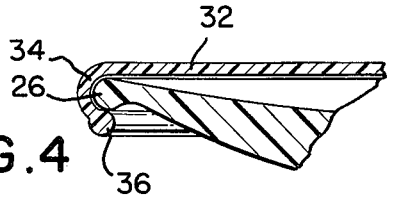
FIG. 4

CAKE PLATE

FIELD OF THE INVENTION

The present invention relates generally to dishes and relates more specifically to a cake plate having a food receiving surface which is a conical well.

BACKGROUND OF THE INVENTION

In the baking of a high rise cake or of a layer cake having a high rise bottom layer the cake is baked in the usual straight sided circular pan. In order for the cake to be light, the cake is allowed to rise above the sides and forms a dome. Then, in order to frost the cake, the pan is turned over and the cake is deposited on the usual flat cake plate. Since, the usual flat cake plate is not configured to support the domed surface of the cake, there results frequent cake breakage.

One solution in the prior art has been to slice off the domed portion of the cake to present a flat surface to rest on the cake plate. This solution has been not entirely satisfactory since it results both in wasting a portion of the cake and in extra labor.

OBJECTS OF THE PRESENT INVENTION

It is an object of the present invention to provide a cake plate which will accommodate and support many varieties of cakes, eliminating unnecessary cake breakage or collapse.

It is a further object of the present invention to provide a cake plate which will support the domed surface of a high rise cake.

It is another object of the present invention to provide a cake plate which will support a high rise cake and which will not inhibit the cutting of the cake.

It is still another object of the present invention to provide a cake plate for a high rise cake which is also adaptable for use with a flat cake.

SUMMARY OF THE PRESENT INVENTION

Briefly, the aforementioned and other objects are satisfied by providing a cake plate having a cake receiving surface which is a conical well for supporting the domed surface of a high rise cake. In order to accommodate flat cakes a flat disc is retained above the conical surface.

Other objects, features, and advantages of the present invention will become apparent upon a perusal of the following detailed description of a preferred embodiment thereof when taken in conjunction with the appended drawing wherein:

FIG. 1 is an elevation cross-section of the cake plate of the present invention.

FIG. 2 is an elevation cross-section of a lid for the cake plate of FIG. 1.

FIG. 3 is an elevational cross-section similar to FIG. 2 but showing the lid of FIG. 2 in place.

FIG. 4 is a blow-up of a portion of FIG. 3.

DETAILED DESCRIPTION

Referring to FIG. 1, the cake plate 10 of the present invention is generally a circularly symmetric dish having a substantially centrally pointed top surface 12 which is a conical well. The conical well has as an included angle 14 ranging between 150 and 170 degrees for supporting without breaking the domed surface 16 of a high rise cake 18.

Conical top surface 12 intersects sharply with an arcuate exterior side surface 20 of plate 10. Side surface 20 is generally a downwardly converging frustrum of a cone which intersects the side of a flat cylindrical bottom portion or base 22. At the intersection of conical well 12 and side surface 20 there is provided a radially projecting toroidal bead 26 the purpose of which will become apparent in connection with the discussion of FIGS. 2 through 4.

Dish 10 may be fashioned from glass, plastic or other suitable material. In order to accommodate up to a 9 inch cake and still fit under most cake covers, the diameter 24 of plate 10 is preferably 11 inches.

It has been found that the included angle 14 must range between 150 and 170 degrees in order to support the variation in domes 16 which are encountered in cake baking. It should be appreciated that top surface 12 makes at most a 20 degree angle with the horizontal and as such, the cutting of cake 18 will not be inhibited.

In a typical design, the overall height of plate 10 is one inch and the wall thickness between the substantially pointed portion 25 of top surface 12 and the bottom of base 22 is ¼ inch yielding an included angle 14 of approximately 166 degrees.

While the foregoing design will give substantial support to a flat cake the lid 28 of FIG. 3 is utilized in conjunction with cake plate 10, as shown in FIGS. 3 and 4, to better support a flat cake 30.

Circulary symmetric lip 28, which is of resilient plastic, comprises a flat circular disc center section 32 which merges at its periphery with a generally downwardly projecting lip 34. Lip 34, comprises in cross section, approximately a 180 degree circular arc terminating in a toroidal bead 36. The arc of lip 34, and the diameter of the lid 28 are chosen so that the lid may fit over top surface 12 of plate 10 with lip 34 snapped over bead 26 on the plate and the lid thereby retained on the plate. The plate 10, is thus converted for accommodating a flat cake 30 on a flat surface, namely the center disc section 32 of lid 28.

It will now be appreciated, that the invention offers a cake plate which is uniquely adapted to receive a high rise cake and which is convertible for receiving a flat cake. It should also be understood that while the preferred embodiment of the present invention have been described in great detail, many of these details may be varied within the spirit and scope of the invention.

Accordingly, what I claim is:

1. A circular dish comprising a food receiving top surface having a centrally pointed conical wall therein, an external side surface intersecting said top surface at the periphery of said top surface and a bottom external surface intersecting said side surface.

2. The dish of claim 1 wherein said conical top surface is characterized by an included angle ranging between 150 and 170 degrees.

3. The dish of claim 2 wherein said bottom surface is substantially flat.

4. The dish of claim 2 further comprising a generally toriodal bead on the periphery of said top surface in combination with a circular disc retained on said bead and above said top surface.

5. The dish of claim 4 wherein said bottom surface is substantially flat.

6. The dish of claim 5 wherein said side surface is a frustrum of a cone.

7. The dish of claim 1 wherein said bottom surface is substantially flat.

8. The dish of claim 1 further comprising a generally toroidally bead on the periphery of said top surface in combination with a circular disc retained on said bead and above said top surface.

* * * * *